US006711846B1

(12) United States Patent
Nasef

(10) Patent No.: US 6,711,846 B1
(45) Date of Patent: Mar. 30, 2004

(54) GUN SIGHT SYSTEM

(76) Inventor: Richard Nasef, 3858 W. Carson St., Suite 218, Torrance, CA (US) 90503

( * ) Notice: Subject to any disclaimer, the term of this patent is extended or adjusted under 35 U.S.C. 154(b) by 0 days.

(21) Appl. No.: 10/289,073

(22) Filed: Nov. 6, 2002

(51) Int. Cl.[7] ..... F41G 1/01
(52) U.S. Cl. ..... 42/130; 42/131; 42/141; 42/144
(58) Field of Search ..... 42/111, 112, 141, 42/144, 130, 131, 132, 133, 113

(56) References Cited

U.S. PATENT DOCUMENTS 2,256,411 A * 9/1941 Russel
3,744,143 A * 7/1973 Kilpatrick
5,519,941 A * 5/1996 Yusko ..... 33/252
6,058,615 A * 5/2000 Uhlmann et al. ..... 42/100
6,058,616 A * 5/2000 Bubits ..... 33/261
6,360,471 B1 * 3/2002 Stein ..... 42/122

* cited by examiner

*Primary Examiner*—Stephen M. Johnson
(74) *Attorney, Agent, or Firm*—Koda & Androlia

(57) ABSTRACT

A gun sight system including a front sight portion and a rear sight portion. The rear sight portion comprises a truncated triangle and the front sight portion comprises a triangle substantially the same size and of the same inclined angle as a truncated portion of the rear sight portion. When the front and rear sight portions are vertically and horizontally aligned, an image of a complete triangle is formed for the user and a target is placed on a top point of the triangle of the front sight portion.

13 Claims, 4 Drawing Sheets

GUN SIGHT SYSTEM

BACKGROUND OF THE INVENTION

1. Field of the Invention

The present invention relates to gun sights used in firearms such as rifles, pistols, shotguns and is particularly well suited to rapid fire weapons used in both competition and combat.

2. Prior Art

Gun sights are devices attached to a gun which a shooter utilizes to aim the gun at a target. The sights most commonly used in rifles, pistols and shotguns are usually notch sights, peep sights, graticule sights and telescopic sights.

Shown in FIGS. 1 and 2 are prior art examples of notch sights. The notch sight of FIG. 1 comprises a rear sight 1 which comprises an opaque block 2 having a notch 4 formed in the upper central portion thereof. The front sight 6 comprises a blade 8. In use, the blade 8 of the front side 6 is aligned with the top surface of the block 2 of the front sight 1 and centered in the notch 4.

FIG. 2 shows another example of a notch sight which comprises substantially the same rear sight 1 made of an opaque block 2 with a notch 4 provided therein. The front sight 6' comprises a cylindrical hollow tube 10. In use, the cylindrical hollow tube 10 of the front sight 6' is centered in the notch 4 of the rear sight 1.

Shown in FIG. 3 is an example of a graticule sight. The graticule sight comprises a graticule pattern 12 formed on a transparent medium 14. In use, the central portion of the graticule pattern 12 is aligned with the target.

The notch sights, peep sights and graticule sights have several problems caused by the way they are designed. Some of these problems are:

1. They require considerable practice and expense for a user to master them;
2. It is difficult to keep the sights aligned while moving the gun or while moving with the gun, thus making it harder to hit a target during rapid fire or during rapid fire on the move;
3. They are ineffective in use in low light conditions such as dusk or dawn;
4. Rapid target acquisition is difficult because these sights are difficult to align; and
5. Cover up too much area on the target.

As to telescopic sights, they are not suitable for rapid fire weapons because they limit or restrict the shooter's view, are slow to sight and are expensive.

SUMMARY OF THE INVENTION

Accordingly, it is a general object of the present invention to overcome the disadvantages and problems of the prior art.

It is a particular object of the present invention to provide a gun sight which is easy to learn and master.

It is still another object of the present invention to provide a gun sight which provides accurate aiming during rapid fire of the weapon as well as precise aiming during slow fire at long distances.

It is yet an other object of the present invention to provide a gun sight which is easy to manufacture and relatively low in cost and which can be adapted easily to most weapons.

In keeping with the principles and objects of the present invention, the gun sight system of the present invention comprises a front sight portion and a rear sight portion. The rear sight portion comprises a truncated triangle and the front sight portion comprises a triangle of substantially the same size as the remaining truncated portion from the rear sight. In addition, when the front and rear sights are vertically and horizontally aligned, an image of a complete triangle is formed for the user. If the target is then placed on top of the point of the triangle of the front sight, complete alignment of the weapon and the target is achieved.

BRIEF DESCRIPTION OF THE DRAWINGS

The above-mentioned features and objects of the present invention will become more apparent with reference to the following description taken together with the accompanying drawings wherein like reference numerals denote like elements and in which:

FIGS. 5, 6, 7 and 8 illustrate a second embodiment of the embodiment of the present invention mounted on a pistol in which FIG. 5 is a perspective view, FIG. 7 is a rear view illustrating the aligned rear and front sights and FIG. 8 is a front view illustrating the aligned sights;

DETAILED DESCRIPTION OF THE INVENTION

Figure 1:
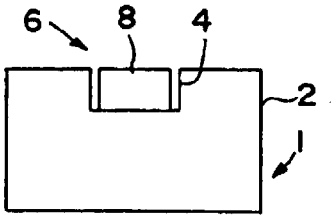
FIG. 1 PRIOR ART
FIGS. 1, 2 and 3 represent prior art gun sights.
Figure 2:
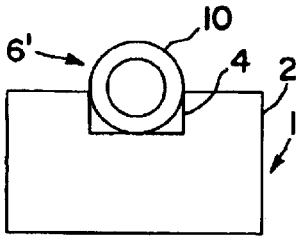
FIG. 2 PRIOR ART
Figure 3:
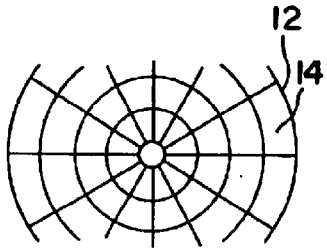
FIG. 3 PRIOR ART
Figure 4A:
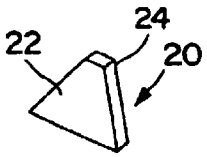
FIGS. 4(*a*), 4(*b*) and 4(*c*) represent simplified views of a first embodiment of the present invention in which FIG. 4(*a*) is the rear sight, FIG. 4(*b*) is the front sight and FIG. 4(*c*) is the image of the aligned front and rear sights.
Figure 4B:
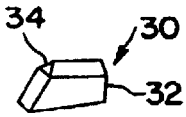
Figure 4C:
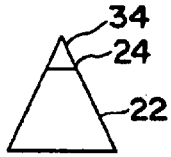

Referring to FIGS. 4(*a*)–4(*c*), shown therein a first embodiment of the present invention. FIG. 4(*a*) is the rear sight 20 comprising an opaque truncated triangular solid 22. The opaque truncated triangular solid 22 is truncated at the peak at 24. The rear sight of FIG. 4(*a*) can be mounted either vertically or at some angle inclined toward the front sight in the manner shown in the second embodiment of FIGS. 5–8 to be described below.

The front sight 30 is shown in FIG. 4(*b*) and essentially comprises an opaque solid blade portion 32 and a triangular portion 34. The triangular portion 34 appears to be the portion of the rear sight 20 which was cut off of the rear sight 20 to form the truncated triangular solid 22. The size of the triangular portion 34 is selected so that when viewed by the user of the weapon, it appears to form a complete triangle with the rear sight 20 when horizontally and vertically aligned with the rear sight 20 as shown in FIG. 4(*c*). In other words, the size of the triangular portion 34 is selected so that based on perspective, distance between the front sight 30 and the rear sight 20 and the distance from the user of the weapon's eye, the triangular portion 34 which maintains the same forward angle as the rear sight fits on top of the truncated triangle solid 22 when aligned vertically and horizontally to provide the user of the weapon with an image of a complete triangle substantially the same as shown in FIG. 4(*c*).

It should be apparent to one of ordinary skill in the art that such an alignment of the front sight 30 and the rear sight 20 can be easily and quickly achieved with the gun sight system of the present invention. In addition, it should be apparent to one of ordinary skill in the art that the front and rear sights 30 and 20 can be easily and inexpensively manufactured from commonly available materials such as metals, plastics and ceramics.

Referring to FIG. 5–8, shown therein is a second embodiment of the gun sight system of the present invention. In this gun sight system of the second embodiment, the front and rear sights 30 and 20', respectively, are provided on a pistol 40 shown in dotted lines in FIGS. 5–8. In this second embodiment, the front sight 30 is substantially the same as that described in the front embodiment and shown in FIG. 4(*b*) and it is provided in a groove 42 in the top front surface of the barrel 44 of the pistol 40. It should be apparent to one of ordinary skill in the art that the front sight 30 could be mounted to the front end of the barrel of the weapon in a variety of different manners such as welding, screws, etc.

Figure 5:
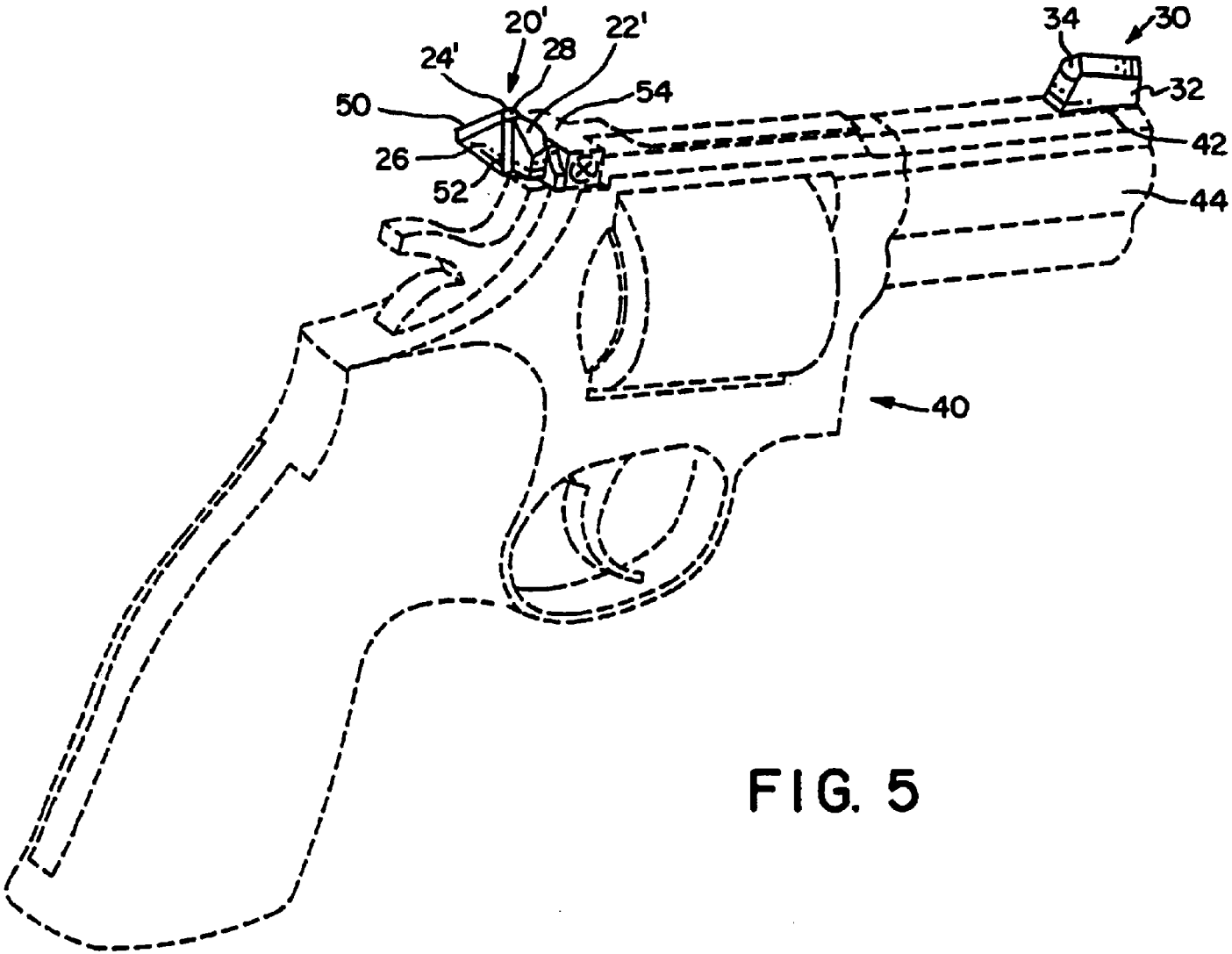
Figure 6:
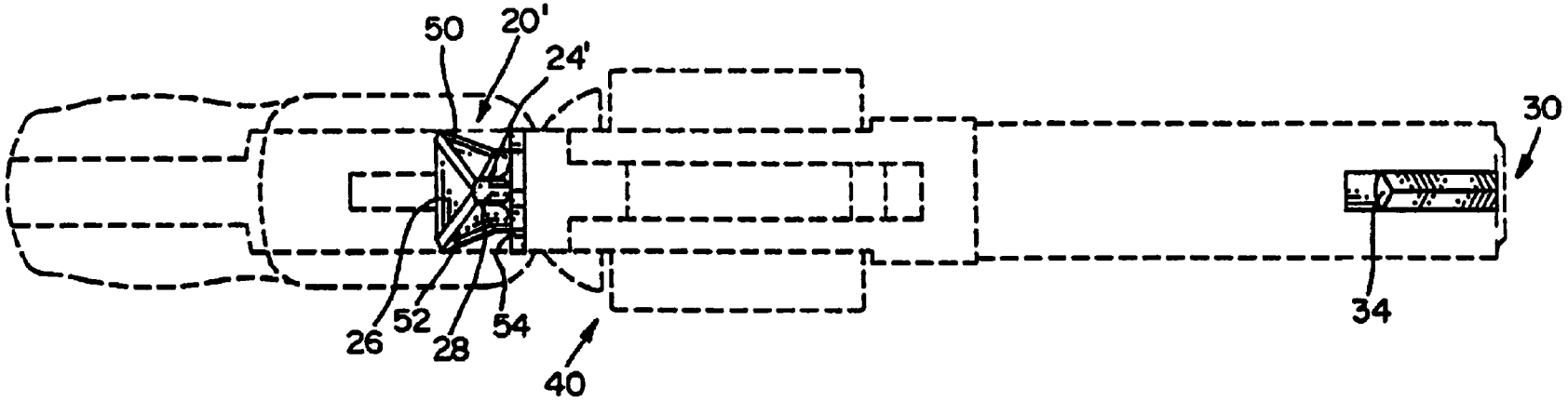
Figure 8:
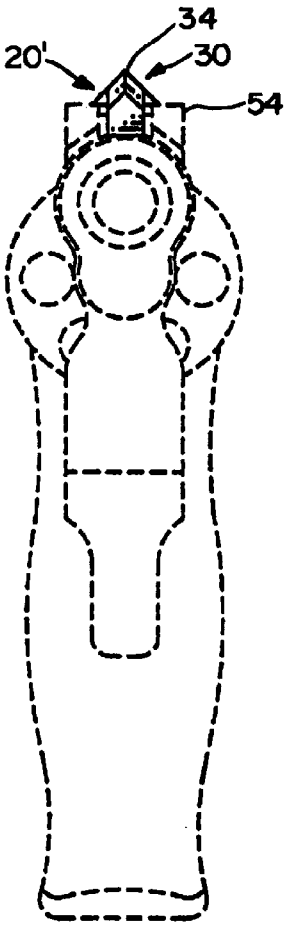
Figure 7:
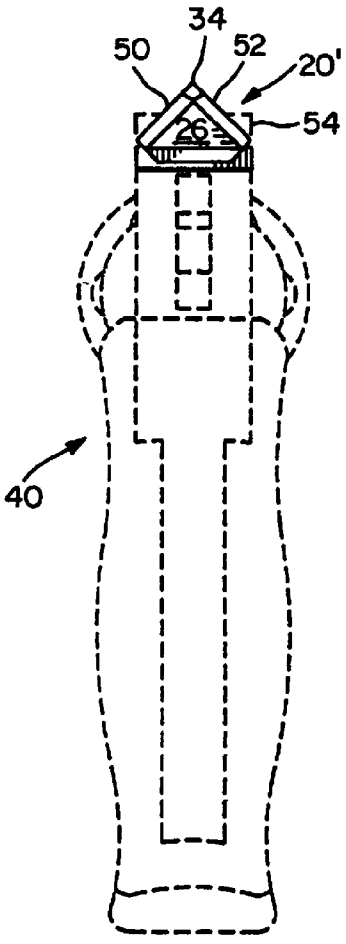

The rear sight 20 comprises a triangular truncated solid 22'. The rear surface 26 of the truncated triangular solid 22' is inclined toward the front of the weapon as is shown in FIGS. 5 and 6. Still further, the rear surface 26 is preferably provided with a groove 28 at the top in the truncated portion 24'. This groove 28 further enhances the speed of alignment of the rear sight 20' and the front sight 30 and particularly with the triangular portion 34 of the front sight 30. Still further, the rear surface 26 is provided with elongated contrasting rectangular markings 50, 52 which are provided along the edge of the truncated triangular solid 22 to also enhance the speed at which the user of the weapon can align the truncated triangular solid 22' with the triangle portion 34 of the front sight 30. These elongated rectangular markings 50 and 52 can be painted with a high contrast colors such as red or day glow orange or ultimately with a luminescent material which would glow in the dark and provide use for the weapon in low light conditions. Still further, the triangular portion 34 can also be provided with contrasting color or luminescent material in the same manner as the elongated rectangular contrasting markings 50, 52 on the rear sight 20'. The luminescent material may be a material such as shown in U.S. Pat. Nos. 6,177,029 and 5,376,303.

The rear sight 20' is mounted to a conventional windage and elevation adjustment means 54 which is provided at the rear of the pistol 40. The rear sight 20' can be attached to the windage and elevation adjustment means 54 by conventional methods such as screw, welding, adhesive, etc. In addition, the front sight can be attached to a barrel of the weapon by any conventional method.

In operation, the front and rear sights 30 and 20' are utilized substantially the same way as the simplified sights shown in the first embodiment of FIGS. 4(*a*)–4(*c*).

Figure 9:
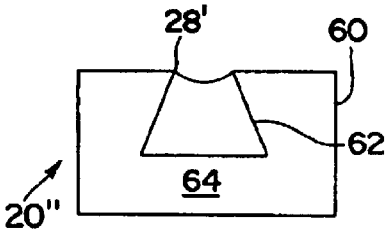
FIG. 9 is a third embodiment of the present invention illustrating the rear sight.
Figure 10:
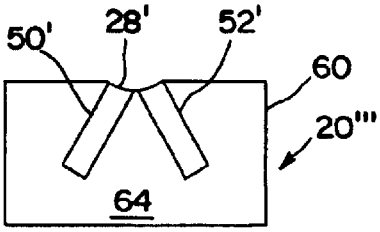
FIG. 10 is a fourth embodiment of the present invention illustrating the rear sight.

Referring to FIGS. 9 and 10, shown therein are third and fourth embodiments of a rear sight of the present invention which could be utilized to further reduce the cost manufacture of the present invention. In particular, FIG. 9 comprises a rear sight 20" which is a rectangular solid 60. The rectangular solid is provided with a groove 28' in the top central portion of the rectangle 60. A truncated triangle 62 is formed on the rear surface 64 of the rectangular solid 60. The truncated triangle 62 can be formed on the rear surface 64 utilizing any conventional method such as etching, contrasting paint, luminescent material, etc.

In the fourth embodiment of FIG. 10, instead of forming a complete truncated triangle 62 as in FIG. 9, a skeleton of a truncated triangle is formed by two elongated rectangular markings 50' and 52'. These elongated triangular portions are similar to the elongated triangular markings 50 and 52 shown in the second embodiment of FIGS. 5–8. These elongated rectangular markings 50' and 52' can be formed also by any conventional method such as etching, contrasting paint, luminescent material, etc.

Still further and in operation, the rear sights 20" and 20'" of the third and fourth embodiments shown in FIGS. 9 and 10 function together with the front sight 30 in the same manner of the front embodiment of FIGS. 4(*a*)–4(*c*).

Figure 11A:
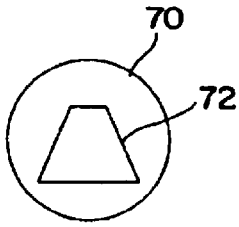
FIGS. 11(*a*) and 11(*b*) illustrate a fifth embodiment of the present invention wherein FIG. 11(*a*) is the rear sight and FIG. 11(*b*) is the front sight.
Figure 11B:
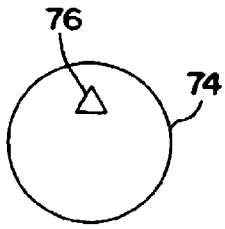

It should also be apparent that the sight system of the present invention could be utilized in other configurations. One such configuration would be to utilize the gun sight system of the present invention in a globe type sight. The globe type sight comprises front and rear portions each made up of hollow cylinders. Into these hollow cylinders are fitted transparent discs. Shown in FIG. 11(*a*) is a transparent disc 70 to be placed in the hollow cylinder of the rear sight. On this transparent disc 70 is printed a truncated triangle 72. Shown in FIG. 11(*b*) is a transparent disc 74 which is to be placed in the hollow cylinder of the front sight. On this transparent disc 74 is printed a triangle 76. The truncated triangle 72 together with the triangle 76 provide, respectively, the rear and front sight portions of the gun sight system of the present invention and together function in substantially the same way as the first embodiment.

It should be apparent to those skilled in the art that the above-described embodiments are merely representative of a few of the possible embodiments which one of ordinary skill in the art could create without departing from the spirit and scope of the invention.

I claim:

1. A gun sight system comprising a front sight portion and a rear sight portion wherein:

the rear sight portion comprises a truncated triangle;

the front sight portion comprises a triangle; and when the front and rear sight portions are vertically and horizontally aligned, an image of a complete triangle is formed for the user; and wherein said triangle of said front sight portion is substantially smaller than said truncated triangle of said rear sight portion whereby sight alignment is hastened.

2. The gun sight system according to claim 1, wherein said truncated triangle of the rear sight portion comprises a truncated triangular solid.

3. The gun sight system according to claim 2, wherein a rear surface of said triangular solid is inclined toward the front sight.

4. The gun sight system according to claim 2, wherein elongated colored portions are provided along the intersecting sides of said truncated triangular solid.

5. The gun sight system according to claim 4, wherein said triangle of said front sight portion is provided with a colored surface.

6. The gun sight system according to claim 2, wherein a luminescent material is provided in elongated portions along the intersecting edges of the truncated triangular solid of the rear sight and on the triangle of the front sight portion.

7. The gun sight system according to claim 2, wherein rear sight portion is adjustable in both elevation and windage.

8. The gun sight system according to claim 1, wherein a truncated portion of said truncated triangle of said rear sight portion is concave and a bottom portion of said triangle of said front sight portion is convex.

9. The gun sight system according to claim 1, wherein a size of the triangle of the front sight portion is selected such that based on perspective, distance between the rear sight portion and the front sight portion and the distance from the user's eye to the weapon, the triangle of the front sight portion sits on top of the truncated triangle of the rear sight portion when aligned vertically and horizontally to provide the user of the weapon with an image of a complete triangle.

10. The gun sight system according to claim 1, wherein the truncated triangle of the rear sight portion is provided on a transparent member and said triangle of said front side portion is provided on separate transparent member.

11. The gun sight system according to claim 1, wherein the truncated triangle of the rear sight portion is provided on a rectangular solid.

12. The gun sight system according to claim 1, wherein the a rear surface of said triangle of said front sight portion is at a same inclined angle as a rear surface of said truncated triangle of said rear sight portion.

13. The gum sight system according to claim 1, wherein a height of the triangle of the front sight portion is substantially less than a height of the truncated triangle of said rear sight portion.

* * * * *